US005937770A

United States Patent [19]

Kobayashi et al.

[11] Patent Number: 5,937,770

[45] Date of Patent: Aug. 17, 1999

[54] PULVERIZED COAL BURNER

[75] Inventors: Hironobu Kobayashi; Hirofumi Okazaki, both of Hitachi; Masayuki Taniguchi, Hitachinaka; Kenji Kiyama, Kure, all of Japan

[73] Assignee: Babcock-Hitachi Kabushiki Kaisha, Tokyo, Japan

[21] Appl. No.: 08/862,256

[22] Filed: May 23, 1997

[30] Foreign Application Priority Data

May 24, 1996 [JP] Japan ..... 8-129451

[51] Int. Cl.[6] ..... F23D 1/00; F23C 1/10

[52] U.S. Cl. ..... 110/263; 110/104 B; 110/261

[58] Field of Search ..... 110/104 B, 260, 110/261, 262, 263, 264, 265

[56] References Cited

U.S. PATENT DOCUMENTS

| | | | |
|---|---|---|---|
| 5,199,355 | 4/1993 | Larue | 110/261 |
| 5,231,937 | 8/1993 | Kobayashi et al. | 110/262 |
| 5,431,114 | 7/1995 | Morita et al. | 110/265 |
| 5,685,242 | 11/1997 | Narato et al. | 110/262 |
| 5,806,443 | 9/1998 | Kobayashi et al. | 110/262 |

FOREIGN PATENT DOCUMENTS

| | | |
|---|---|---|
| 409102 | 1/1991 | European Pat. Off. . |
| 0445938 | 9/1991 | European Pat. Off. . |
| 0672863 | 9/1995 | European Pat. Off. . |
| 0687857 | 12/1995 | European Pat. Off. . |
| 63-21406 | 1/1988 | Japan . |
| 3-41571 | 2/1991 | Japan . |
| 3-110308 | 5/1991 | Japan . |
| 4-24404 | 1/1992 | Japan . |
| WO9513502 | 5/1995 | WIPO . |

*Primary Examiner*—Ira S. Lazarus
*Assistant Examiner*—Ljiljana V. Ciric
*Attorney, Agent, or Firm*—Fay, Sharpe, Beall, Fagan, Minnich & McKee

[57] ABSTRACT

A pulverized coal burner includes a venturi for contracting a flow of a mixture of pulverized coal and primary air toward a central axis of a fuel nozzle 2. A spindle having a cone is provided coaxially with the central axis and gradually expands from an upstream side to a downstream side to cause the mixture to impinge thereon and diffuse. A column extends from the cone and is parallel to the central axis of the fuel nozzle, and a cone extends from the column and gradually narrows from an upstream side to a downstream side. A flow path divider, having a cone gradually narrowing coaxially with the central axis on the downstream side of the spindle, and a cylinder extending from the cone and being coaxial and parallel with the central axis of the fuel nozzle 2, coaxially divides the flow path.

8 Claims, 4 Drawing Sheets

PULVERIZED COAL BURNER

BACKGROUND OF THE INVENTION

The present invention relates to a pulverized coal burner which transfers pneumatically and burns pulverized coal and, more particularly, to a pulverized coal burner which raises the stability of flame in a low load operation and suppresses occurrence of nitrogen oxides.

Pulverized coal burning is required to suppress occurrence of nitrogen oxides (hereunder, referred to as NOx) to a small amount. Most of the NOx generated during burning of pulverized coal is NOx generated by oxidation of nitrogen contained in the coal. In order to reduce the amount of NOx generated in burning, various constructions of pulverized coal burners have been proposed.

As a pulverized coal burner which decreases an amount of NOx generated in burning, there is a pulverized coal burner in which a reducing zone and oxidizing zone are formed, that is, a so-called flame-inside-two-stage-burning burner. Nitrogen in the coal is released into gas phase as cyanide hydrogen (HCN) and ammonia ($NH_3$) during thermal decomposition of pulverized coal at an initial time of combustion. Those nitrogen compounds are oxidized to become NOx while they have an effect of reducing NOx in a low oxygen-concentration region. The flame inside two stage burning realized effectively, inside flame, is a reaction which reduces NOx with NOx precursors such as $NH_3$, HCN. In the burning, a reducing zone is expanded by fuel-excess burning with air shortage around the pulverized coal burner in the flame and an oxidizing zone is formed by high oxygen concentration burning at a downstream side of the flame.

In order to raise the effect of the flame inside two stage burning, it is necessary to stably form flame of pulverized coal supplied from a fuel nozzle. Therefore, it has been tried to change the supply condition of pulverized coal and carrier air. A pulverized coal burner inside which a member is arranged to adjust the particle concentration is disclosed in JP A 63-21406, JP A 3-41571, JP A 3-110308 or JP A 4-24404, for instance.

However, in the flame-inside-denitration-type pulverized coal burner applied to a pulverized coal burning boiler, it is important to promote a reducing reaction in a reducing flame zone in order to reduce the concentration of emitted NOx. In order to achieve it, it is important to achieve fuel-excess burning and raise the ability of thermal decomposition of pulverized coal in the reducing flame zone by not only improving the construction for supplying combustion air but improving the construction for supplying pulverized coal.

In order to raise the operability of the pulverized coal burning boiler, a load is changed in a short time. In view of this point, it is important to expand the lower limit of operation of the pulverized coal burner to a low load.

However, in the pulverized coal burner, it is impossible to reduce a flow rate of pulverized coal particles flowing in a pulverized coal transfer pipe to a certain speed or less. Therefore, it is limited to reducing a flow rate of air supplied in the pulverized coal transfer pipe. When the flow rate of pulverized coal particles is too small, there are such fears that the pulverized coal particles sink in the transfer pipe, the transfer pipe is choked, and flames in the furnace flow back into the transfer pipe.

For this reason, when the flow rate of pulverized coal and the flow rate of air are decreased in order to expand the lower limit of an operation of the pulverized coal burner to a low load, it is necessary to keep the flow rate of pulverized coal feed (or carrier) air at a certain level and decrease a feed rate of pulverized coal, after the load is lowered to some level of load.

When the feed rate of pulverized coal only is decreased, the concentration of pulverized coal contained in the pulverized coal feed air becomes lower. For this reason, pulverized coal flame is formed away from the outlet of the fuel nozzle. This means that the pulverized coal burns after the pulverized coal and combustion gas are mixed with each other. As a result, it is difficult to form a reducing zone of NOx inside the flame.

SUMMARY OF THE INVENTION

A first object of the invention is to solve the above-mentioned problems and to provide a pulverized coal burner in which the stability of flame in a low load operation is raised to improve the burning efficiency of pulverized coal, and the ability of thermal decomposition of pulverized coal in a reducing flame zone is raised to enlarge the reducing flame zone and suppress the occurrence of NOx.

A second object of the invention is to provide a pulverized coal burner in which an amount of use of a stabilizing fuel such as, by expanding a burner load range in which burning can be effected with fuel of only pulverized coal.

In order to achieve the above objects, the present invention includes, in a pulverized coal burner having a fuel nozzle for feeding a mixture of pulverized coal and air and an air nozzle, arranged coaxially with and outside the fuel nozzle, for supplying combustion air in a state of swirling flow, the above-mentioned fuel nozzle comprises a constricted throat for contracting a flow of the mixture toward a central axis of the fuel nozzle, an impinged diffuser having an expanding portion, provided on a central axis of and on the downstream side of the constricted throat, expanding gradually from an upstream side to an downstream side and causing the mixture to impinge thereon and diffuse thereby, and a flow path divider having a narrowing cylinder portion, provided coaxially with the fuel nozzle on the downstream side of the impinged diffuser and gradually narrowing from an upstream side to a downstream side, and dividing the flow path.

The burner in which the fuel nozzle has a constricted throat, an impinged diffuser having an expanding portion, and a flow path divider having a narrowing cylinder portion and dividing coaxially the flow path, has the constricted throat reducing a flow path area on the upstream side of the fuel nozzle, so that pulverized coal in the vicinity of the wall surface of the fuel nozzle impinges on a flow inlet of the constricted throat and the concentration of the pulverized coal is raised thereby. The impinged diffuser having an expanding portion arranged on the downstream side of the constricted throat causes the pulverized coal of a central portion of the fuel nozzle to impinge thereon to raise the concentration and causes the pulverized coal particles concentrated by the constricting portion to impinge thereon. That is, fuel on outer and inner sides in the fuel nozzle impinges on an outer surface of the expanding portion of the impinged diffuser, with the concentration being raised. Thereby, a flow direction of particles is shifted to the outer side in the fuel nozzle and the pulverized coal concentration also is raised there.

The pulverized coal particles, which are changed in the flow direction by the expanding portion of the impinged diffuser and made higher in the concentration, maintain temporarily their flow direction by their inertia, whereby pulverized coal of relatively large particles are collected to an opening edge portion of the fuel nozzle. The flow divider on the downstream side of the impinged diffuser divides coaxially the flow path of the fuel nozzle, and rectifies pulverized coal flows in the outer flow path and inner flow path. That is, by arranging the flow path divider, flows of carrier air in the outer and inner flow paths become equal to each other, and a radial gradient of speed is decreased.

Further, since the fuel concentration on the outer side divided by the flow path divider becomes high, it is possible to maintain stably flame, even at a time of low load operation in which the fuel concentration is low and even with low-volatile coal. The ability of thermal decomposition of pulverized coal in the reducing flame zone, particularly, stability of flame at a time of low load operation is raised and occurrence of NOx is suppressed.

Further, in a pulverized coal burner which has a fuel nozzle for feeding a mixture of pulverized coal and air and an air nozzle, arranged on both sides of the fuel nozzle, for supplying combustion air, the above-mentioned fuel nozzle comprises a constricted throat for contracting a flow of the mixture toward a central axis of said fuel nozzle, an impinged diffuser having an expanding portion, provided on a central axis of and on the downstream side of the constricted throat, expanding gradually from an upstream side to an downstream side and causing the mixture to impinge thereon and diffuse thereby, and a flow path divider having a narrowing cylinder portion, provided coaxially with the fuel nozzle on the downstream side of the impinged diffuser and gradually narrowing from an upstream side to a downstream side, and dividing coaxially the flow path.

In a pulverized coal burner having the air nozzle, arranged on both sides of the fuel nozzle, for supplying combustion air, a burner in which the fuel nozzle has the constricted throat, the impinged diffuser having an expanding portion, and the flow path divider having the narrowing cylinder portion and dividing coaxially the flow path, has the same operation as the above-mentioned pulverized coal burner provided with the air nozzle on both sides of the fuel nozzle. Further, in the above-mentioned pulverized coal burners, the impinged diffuser has a parallel portion, being parallel to the central axis of the fuel nozzle and provided on the central axis of the fuel nozzle so as to extend from the expansion portion, and a narrowing portion, narrowing from an upstream side to a downstream side, and provided on the central axis of the fuel nozzle so as to extend from the parallel portion. The burner, in which the impinged diffuser has the parallel portion which extends from the expanding portion and is parallel to the central axis, and the narrowing portion which extends from the parallel portion and gradually narrows along the central axis, changes the mixture flow direction to a direction along the central axis of the fuel nozzle by the parallel portion, in addition to the operation of the above-mentioned burners, whereby relatively fine particles flow in the vicinity of the outer surface of the parallel portion and the concentration of particles becomes lean. The narrowing portion operates so that the mixture flows along the outer surface of the narrowing portion, and since the relative fine particles flowing in the vicinity of the parallel portion follow the gas flowing on the outer surface of the narrowing portion, a concentration gradient in the radial direction of the fuel nozzle is further increased. Thus, pulverized coal of relatively fine particles is fed to the furnace from a central portion in the outlet of the fuel nozzle and pulverized coal of relatively large particles is fed from an outer side in the outlet of the fuel burner.

Further, in the above-mentioned burner, the apex angle of the expansion portion of the impinged diffuser is in a range from 15° to 40°. In a case where the apex angle of the expanding portion of the impinged diffuser is in a range from 15° to 40°, in addition to the operation of the above-mentioned pulverized coal burners, classification of particles by the impinged diffuser is most effectively carried out. When the apex angle of the expanding portion is 15° or less, change in the flow direction at the expanding portion is small, so that the speed component in the diameter direction of the fuel nozzle becomes small and the classification of the particles becomes very weak. On the other hand, when the apex angle of the expanding portion becomes 40° or more, the surface of the expanding portion becomes likely to be worn by the impingement of particles, and pressure loss of the fuel nozzle increases.

Further, in any of the above-mentioned pulverized coal burners, an apex angle of the narrowing portion of the impinged diffuser is in a range from 5° to 20°. In case where the apex angle of the narrowing portion of the impinged diffuser is in a range from 5° to 20, in addition to operation of any of the above-mentioned pulverized coal burners with the above-mentioned narrowing portion, the flow is not separated at the outer surface of the narrowing portion and the classification of particles is maintained. When the apex angle of the narrowing portion becomes 5° or less, the impinged diffuser becomes too large to be accommodated within the fuel nozzle. When the apex angle of the narrowing portion becomes 20° or more, the flow is separated at the outer surface of the narrowing portion, so that the classification of particles is extremely lowered.

Further, in any of the above-mentioned pulverized coal burners, the above-mentioned flow path divider has a parallel cylinder portion which is provided coaxially with the central axis of the fuel burner to be parallel to the central axis and extend from the narrowing portion. In a case where the flow path divider has the parallel cylinder portion extending from the narrowing portion and being parallel to the central axis, in addition to the operation of any of the above-mentioned pulverized coal burners, feeding speed directions in the outer side and in the inner side of the parallel cylinder portion can be the same as each other because both of the fuel flows in the inner and outer sides of the parallel cylinder portion flow along the parallel flow portion, so that even after being jetted into a furnace, mixing of fuel jet flow in a radial direction can be suppressed. Thereby, since a greater amount of fuel of small diameter particles can be supplied to the NOx reducing zone, a NOx-reducing reaction can be promoted and the concentration of NOx emitted from the pulverized coal burner can be lowered. Further, since a projection area of the parallel cylinder portion toward the furnace is one corresponding to the thickness of the plate and can be made very small, radiation from the furnace becomes small and burning damage of the pulverized coal burner at time of oil burning, and at idle time can be prevented. Further, since an amount of air necessary for cooling can be made small, an excess air amount is reduced and the thermal efficiency of the furnace can be raised.

In any of the above-mentioned pulverized coal burners, an angle between the outer surface of the above-mentioned narrowing portion and the central axis of the fuel burner is in a range 2° to 10°. In a case where the angle between the outer surface of the narrowing portion and the central axis of the fuel burner is in a range 2° to 10°, in addition to the operation of any of the above-mentioned pulverized coal burners, when the angle between the outer surface of the narrowing portion and the central axis of the fuel burner is 10° or more, a flow of the mixture is separated from the outer surface of the narrowing cylinder portion and can not flatten a flow distribution on the downstream side. When the angle between the outer surface of the narrowing portion and the central axis of the fuel burner is less than 2°, the narrowing cylinder portion is elongated, so that it can not be accommodated within the fuel nozzle and the flattening operation of the flow distribution on the downstream side becomes extremely small. Therefore, the angle is desirable to be in a range 2° to 10°.

Further, in a pulverized coal burner having an air nozzle supplying combustion air, arranged on both sides of a fuel nozzle for supplying a mixture of pulverized coal and air, the fuel nozzle comprises a constricted throat for contracting a flow of the mixture so as to cause the flow to approach from one side wall to other side wall, an impinged diffuser approaching the flow from an upstream side to a downstream side and the one side wall to the other side wall on the downstream side of the constricted throat, and causing the mixture to impinge and to diffuse, and a flow path divider dividing the flow path on the downstream side of the impinged diffuser.

The burner, which has the constricted throat for contracting a flow of the mixture so as to cause the flow to approach from one side wall to other side wall, the impinged diffuser gradually approaching the flow from one side wall to the other side wall, and causing the mixture to impinge and to diffuse, and the flow path divider dividing the flow path, has the same operation as the previously mentioned pulverized coal burner provided with the air nozzles supplying combustion air on both sides of the fuel nozzle, and can form stable flame in the vicinity of the pulverized coal burner, so that thermal decomposition of pulverized coal is promoted and the concentration of NOx is reduced.

In any of the above-mentioned pulverized coal burners, the fuel nozzle has, at its tip portion, a deflection plate for deflecting a flow of combustion air for the air nozzle toward the outside and impingement plates for causing the mixture to impinge thereon. In the burner, provided with the deflection plate and the impingement plates at the tip portion of the fuel nozzle, in addition to operation of any of the above-mentioned pulverized coal burners, the deflection plate deflects flow of combustion air from the tip portion of the burner outside. Further, the impingement plates cause eddies or vortexes at the tip portion of the fuel nozzle, enlarge a reverse flow zone of the mixture formed on the downstream side of the fuel nozzle tip, an igniting position of pulverized coal approaches the pulverized coal burner, and the combustion efficiency of pulverized coal increases. Additionally, the temperature becomes high at a position close to the pulverized coal burner, and consumption of oxygen increases, so that the reducing flame zone becomes large and occurrence of NOx is suppressed.

DESCRIPTION OF EMBODIMENTS OF THE INVENTION

Figure 1:
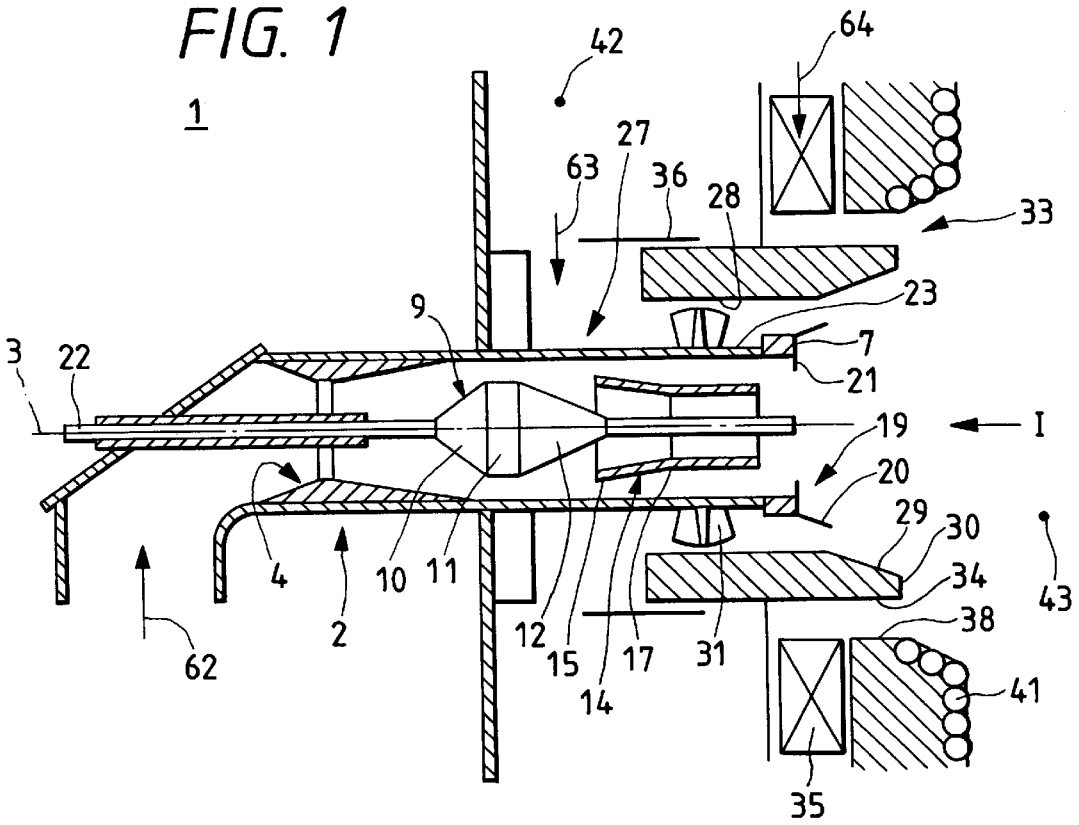
FIG. 1 is a sectional view of a pulverized coal burner of a first embodiment according to the present invention.

Embodiments of the invention are explained hereunder in detail, referring to the drawings. In FIGS. 1 to 9, the same reference numbers are given to the same operation parts.

Figure 2:
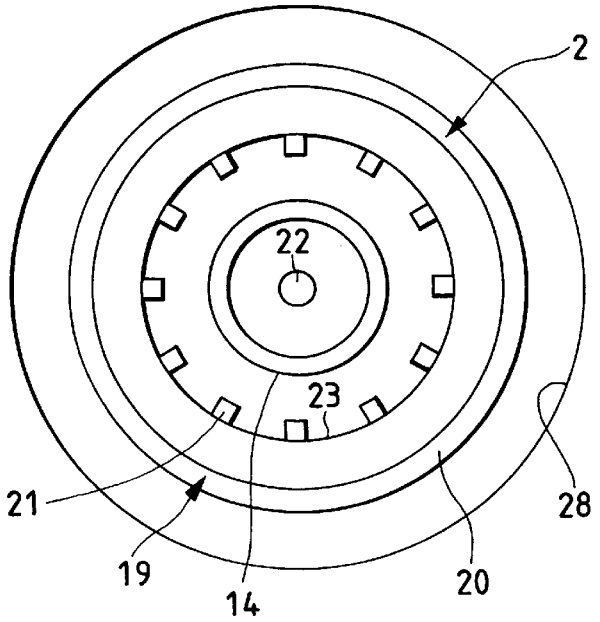
FIG. 2 is a view in the direction of arrow I in FIG. 1.

FIG. 1 is a sectional view of a first embodiment of the pulverized coal burner according to the present invention. FIG. 2 is a view in the direction of arrow I of FIG. 1.

The pulverized coal burner 1 of the first embodiment is a burner suitable for a pulverized coal burning boiler which burns pulverized coal and generates steam, and the burner has a fuel nozzle 2, provided at a position of a central axis, for feeding a mixture 62 of pulverized coal and primary air. Further, a secondary air nozzle 27 and a third air nozzle 33 for supplying, as combustion air in a state of swirling flow, secondary air 63 and third air 64, respectively, are provided outside and coaxially with the fuel nozzle 2. The two air nozzles 27, 33 are flow paths for supplying the combustion air supplied in a wind-box 42 into a furnace 43.

Here, the fuel nozzle 2 is a tubular flow path, the outer wall of which is a primary throat 23, and has an oil gun 22, for feeding a stabilizing fuel, mounted on a central axis 3 of the fuel nozzle 2, to preheat water pipes 41 mounted on the inner wall of the furnace 43. Further, the fuel nozzle 2 has a venturi 4 which is a constricted throat contracting a flow of the mixture 62 from an upstream side toward the side of the central axis 3 of the fuel nozzle 2, a spindle 9 which is an impinged diffuser provided coaxially with the central axis of the fuel nozzle on the downstream side of the venturi 4, gradually expanding from an upstream side to a downstream side and causing the mixture 62 to impinge thereon and diffuse, and a distributor 14, which is a flow path divider dividing coaxially the flow path, provided coaxially with the central axis of the fuel nozzle on the downstream side of the spindle 9, and having a cone 15 which is a narrowing cylinder portion gradually narrowing from the upstream side to the downstream side.

Further, the fuel nozzle 2 has a stabilizer 19 at a tip thereof. The stabilizer 19 has a deflection plate 20 deflecting a flow of secondary air 63 of the secondary air nozzle 27, and impingement plates 21 for causing the mixture 62 to impinge thereon. As shown in FIG. 2, a plurality of the impingement plates 21 are mounted in a circumferential direction.

The venturi 4 is for raising the concentration of pulverized coal transferred from a pulverized coal supply apparatus not shown in FIG. 1 and supplying the pulverized coal. The area of the minimum flow path cross-section of the venturi 4 30 to 70% of the flow path cross-sectional area of the fuel nozzle 2, whereby a drift of particles by a bent pipe portion, etc. at the upstream side of the fuel nozzle 2 can be suppressed.

The spindle 9 has a cone 10 which is an expanding portion, a column 11 which is a parallel portion extending from the cone 10 to be coaxial and parallel with the central axis 3 of the fuel nozzle 2, and a cone 12 which is a narrowing portion extending from the column 11, provided coaxially with the central axis 3 of the fuel nozzle and gradually narrowing from the upstream side to the downstream side. The apex angle of the cone 10 is 15–40° and the apex angle of the cone 12 which is the narrowing portion is 5–20°.

Further, the distributor 14 has a cylinder 17 which is a parallel cylinder portion extending from the cone 15 to be coaxial with and parallel to the central axis 3 of fuel nozzle. An angle between the outer surface of the cone 15 and the central axis 3 of the fuel nozzle is 2–10°.

The secondary air nozzle 27 is an annular flow path, the inner wall of which is the primary throat 23 and the outer wall is a secondary throat 28. The annular flow path is provided with secondary air swirling vanes 31 and a damper 36 on the flow path from the furnace 43 to the upstream side. The secondary air swirling vanes 31 supply secondary air 63 while swirling it. The secondary air swirling vanes 31 are axial flow type swirling flow generators, and have a plurality of vanes arranged in the flow path in a peripheral direction and a supporting bar integrating the vanes. The intensity of the swirling flow passing through the secondary air swirling vanes 31 is adjusted by changing an angle of the vanes by a drive apparatus not shown.

The damper 36, which adjusts a flow rate of secondary air 63 and has a cylindrical shape, is mounted at the position covering an opening communicating the secondary throat 28 and the wind-box 42, and moved in a direction parallel with the central axis of the burner by an adjustor (not shown in FIG. 1) to change an area of the above-mentioned opening. By this operation, a distribution ratio of secondary air 63 and third air 64 is adjusted.

The third air nozzle 33 is an annular flow path, the inner wall of which is a third throat 34 and the outer wall of which is a burner throat 38. Third air 64 from the wind-box 42 is swirled and supplied into the furnace 43 through third air swirling vanes 35.

The secondary throat 28 and third throat 34 are separated in a radial direction, and the partitioning portion has a diameter-expanded portion 29 so that a furnace side end face of the secondary throat 28 is axially extended while being expanded in a radial direction, and a partition wall 30 which is a perpendicular annular wall face facing the furnace 43.

The pulverized coal burner 1 of the first embodiment having the above-mentioned construction, that is, the burner 1 in which the fuel nozzle 2 has the venturi 4, the spindle 9 with the cone 10, and the distributor 14 having the cone 15 and dividing coaxially the flow path, operates as follows. The pulverized coal flowing in the vicinity of the wall of the fuel nozzle 2 impinges on the wall surface of the venturi 4 on the inflow side, whereby the concentration thereof is raised. The spindle 9 arranged downstream of the venturi 4 causes the pulverized coal raised in concentration to impinge on the outer surface of the cone 10, thereby to direct the flow direction to the inner wall surface of the fuel nozzle 2. Thereby, in the parallel portion of the spindle 9, the pulverized coal of high concentration can flow in the vicinity of the inner wall of the fuel nozzle 2.

Further, in the burner in which the spindle 9 has the column 11 extending from the cone 10 and being parallel to the central axis 3, and the cone 12 gradually narrowing on the central axis 3, the flow direction of the mixture 62 is changed to a direction along the central axis of the fuel nozzle 2 by the column 11, and relatively fine particles flow in the vicinity of the outer surface of the column 11 and the concentration is lowered there. The cone 12 operates the mixture 62 so as to flow along the outer surface of the cone 12, and relatively fine particles flowing in the vicinity of the column 11 follow the gas flowing on the outer surface of the cone 12, and a concentration gradient in the radial direction of the fuel nozzle 2 is further increased.

Further, in the burner in which the apex angle of the cone 10 of the spindle 9 is 15–40°, classification of particles is effectively performed by the spindle 9. When the apex angle of the cone 9 is 15° or less, since a change of the flow direction at the cone 10 is small, a speed component in the radial direction of the fuel nozzle 2 becomes small, and classification of particles at the column 11 becomes extremely weak. On the other hand, when the apex angle of the cone 10 is made 40° or more, the outer surface of the cone 10 is easily worn away by impingement of the particles and pressure loss of the fuel nozzle 2 increases.

Further, when the apex angle of the cone 12 of the spindle is 5° or less, the spindle becomes larger so that it can not be accommodated within the fuel nozzle 2. When the apex angle of the cone 12 becomes 20° or more, since the flow is separated at the outer surface of the cone 12, the classification of particles is extremely lowered. Further, the apex angle of the cone 12 on the downstream side is desirable to be smaller than the apex angle of the cone 10 on the upstream side. The pulverized coal particles, changed in flow direction thereof by the spindle 9 and having a high concentration, maintain temporarily their flow direction by their inertia, whereby pulverized coal particles of relatively large diameter are collected to an opening edge portion of the fuel nozzle 2. The opening edge portion is an outer side portion in the outlet of the fuel nozzle, including plates of the stabilizer 19.

Further, the flow path of the fuel nozzle 2 is coaxially divided by providing the distributor 14 on the downstream side of the spindle 9, and flows of pulverized coal in the outer flow path and the inner flow path are rectified. That is, by arranging the distributor 14, carrier air in the outer side and the inner side are made equal to each other and a speed gradient in the radial direction is decreased.

Further, since the concentration of pulverized coal in the outer side of the distributor 14, divided by the distributor 14 becomes high, flame can be stably maintained even with low-volatile coal, and even at a time of low load operation in which low concentration pulverized coal is used, the ability of thermal decomposition of pulverized coal in the reducing flame zone, particularly, the stability of flame at a low load is raised, and occurrence of NOx is suppressed.

Further, the burner, in which the distributor 14 has the cylinder 17 extending from the cone 15 and being parallel to the central axis, can jet fuel inside and outside the cylinder 17 in the same direction as each other, so that even after feeding into the furnace, mixing of fuel jet flows in the radial direction can be suppressed. Thereby, a greater amount of fuel of small diameter particles can be supplied in the NOx reducing zone, NOx reduction can be promoted, and the concentration of NOx discharged from the pulverized coal burner is decreased.

A projection area of the cylinder 17 to the direction of the furnace is only an area corresponding to the thickness of a plate, and can be made very small, so that radiation from the furnace becomes small and burning damage of the pulverized coal burner at a time of oil burning and at a idling time can be prevented. Further, since an amount of air necessary for cooling can be made small, it is possible to decrease excess air and raise the thermal efficiency of the furnace.

Further, when an angle between the outer surface of the cone 15 and the central axis 3 of the fuel nozzle exceeds 10°, the flow of the mixture 62 is separated from the outer surface of the cone 15 and it is impossible to flatten a flow speed distribution on the downstream side. When the angle between the outer surface of the cone 15 and the central axis 3 of the fuel nozzle is less than 2°, the length of the cone 15 becomes long, so that it can not be accommodated within the fuel nozzle and the speed distribution can not be flattened on the downstream side. Therefore, the angle between the outer surface of the cone 15 and the central axis 3 of the fuel nozzle is desirable to be in a range of 2 to 10°.

In the burner, in which the stabilizer 19 having the deflection plate 20 and the impingement plates 21 are provided at the tip portion of the fuel nozzle 2, the deflection plate 20 deflects the flow of secondary air from the tip 7 of the fuel nozzle to the outside. The impingement plates 21 generate eddies or vortexes in the vicinity of the tip 7 of the fuel nozzle. As shown in FIG. 2, in the first embodiment, since the deflection plate 20 for deflecting the flow of secondary air from the tip 7 of the fuel nozzle to the outside and the impingement plates 21 which area bar to the flow are provided at the tip portion of the fuel nozzle 2, a reverse flow zone formed, at a downstream side between the fuel nozzle 2 and the secondary nozzle 27, that is, right downstream of the stabilizer 19, is made large. Therefore, an ignition position of pulverized coal approaches to the opening portion of the pulverized coal burner 1, and the combustion efficiency of pulverized coal is raised. Since temperature becomes high at a position close to the pulverized coal burner 1, and consumption of oxygen progresses, the reduction flame zone becomes large and occurrence of NOx is suppressed.

Further, in the present invention, by providing the diameter-enlarged portion 29 expanding gradually the flow path of the secondary air nozzle 27 from the tip portion of the fuel nozzle 2, axial flow speed of secondary air 63 is retarded, and swirling speed can be maintained. At this time, the size of the reverse flow zone formed downstream of the stabilizer 19 of the fuel nozzle 2 is determined according to the swirling intensity of secondary air 63. Therefore, even under the condition that a flow rate of combustion air is small, the scale of a reverse flow zone formed right downstream of the stabilizer 19 becomes equal to that under the condition that a flow rate of the combustion air is large, by increasing a flow rate of secondary air 63 occupied in the combustion air or increasing swirling speed component by changing the angle of the secondary air swirling vanes 31. Thereby, even under the condition of a small flow rate of combustion air, pulverized coal can be ignited by the stabilizer 19. This method is excellent in that stable flame can be attained with low pressure loss, compared with a method of operating the swirling intensity of third air 64, the flow rate of which is larger than the secondary air 64.

The pulverized coal burner 1 of the present embodiment has the following excellent points by providing the distributor 14 having the cone 15, compared with a guide cylinder disclosed, for example, in JP A 3-110308.

That is, first, since only an upstream side end of the distributor 14 is close to the inner wall surface of the fuel nozzle 2, and the other portion is separated away from the inner wall surface of the fuel nozzle 2, the pressure loss of the flow path on the inner side of the distributor 14 can be made small. In a case where the upstream side of the distributor 14 has the same radius, a flow rate of carrier air including pulverized coal of high concentration flowing in the outer pipe passage of the distributor 14 becomes large, and a ratio of pulverized coal distributed in a high concentration side increases. Therefore, it is possible to widen a region of a high pulverized coal concentration at the opening edge portion of the fuel nozzle 2. Since the thickness of a fuel jet flow of high concentration in the radial direction increases, it is possible to maintain the fuel jet flow of high concentration even inside the furnace, reducing atmosphere within the flame can be effectively generated and pulverized coal can be burnt with low NOx emission.

On the other hand, under the condition of the same pressure loss, the upstream side end of the distributor 14 can be approached to the wall surface of the fuel nozzle 2. Since the concentration of pulverized coal is higher as it is closer to the wall surface of the fuel nozzle 2, the concentration of pulverized coal on the outer side divided out by the distributor 14 becomes high, flame can be maintained stably even at a time of a low load operation in which low concentration fuel is used, and at a time of burning of low-volatile coal.

Second, since the downstream side end of the distributor 14 is parallel to the central axis of the fuel nozzle 2, and jetting speed in the outer side and the inner side of the distributor can be the same in direction, even after being jetted into the furnace, mixing of fuel jet flows in the radial direction can be suppressed. Thereby, since a greater amount of fuel of small diameter particles can be supplied to the NOx reducing zone, NOx reducing reaction is promoted, and the concentration of NOx emitted from the burner decreases.

Third, a projection area, of the distributor 14 to the direction of the furnace, in the vicinity of the end surface of the downstream side is only an area corresponding to the thickness of the plate, and can be made very small. When the above-mentioned projection area is small, radiation from the furnace becomes small. In a case where oil is burnt by the pulverized coal burner and even in a case where pulverized coal is not fed, since the radiation received by the burner is small, the pulverized coal burner undergoes little burning damage. Further, since an amount of air necessary for cooling can be made small, it is possible to decrease excess air and raise the thermal efficiency of the boiler.

Figure 3:
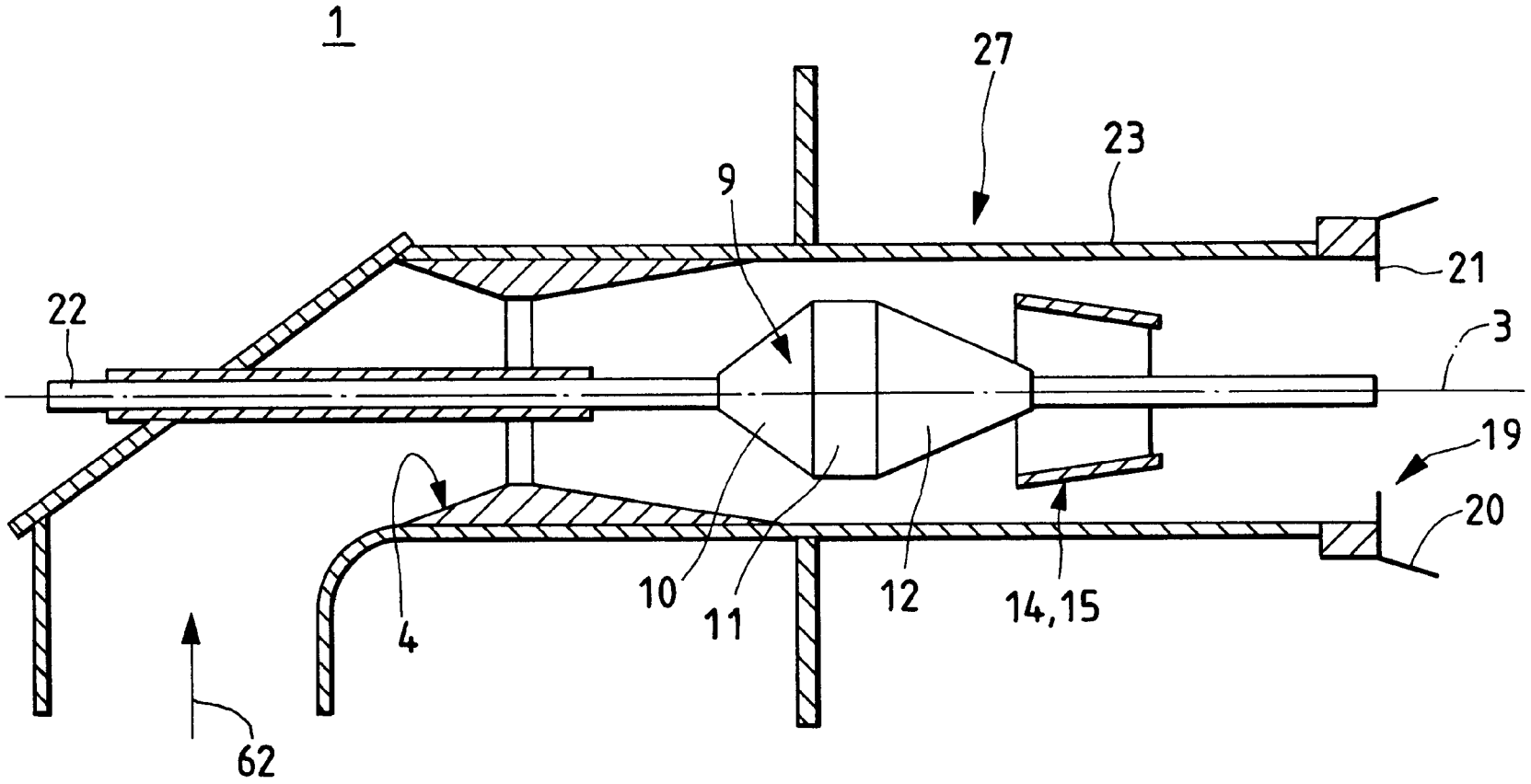
FIG. 3 is a sectional view, omitted in part, of a second embodiment similar to FIG. 1.

FIG. 3 is a sectional view, a part of which is omitted, of a second embodiment similar to FIG. 1. In a pulverized coal burner 1 of the second embodiment shown in this figure, the portions modified in comparison with the burner of FIG. 1 are shown, and the other portions are omitted. In the pulverized coal burner 1 of the second embodiment, a distributor 14 which is a flow path divider is made of only a cone 15 which is a narrowing cylinder portion, and by this, flow speed distribution on the downstream side of the spindle 9 is flattened. An angle of the cone 15 is desirable to be in a range of 2 to 10°. As mentioned above, in the range of the angle, separation of a mixture flow from the outer side surface of the cone 15 is suppressed.

The pulverized coal burner of the second embodiment has an object to flatten the flow speed distribution on the downstream side of the cone 15. In order to achieve the object, it is necessary to flow air along the inner peripheral surface and the outer peripheral surface of the cone 15. Therefore, it is particularly important that air flows along the outer peripheral surface, and separation of air at the outer peripheral surface of the cone 15 should be suppressed. Once air flow is separated, particles can not diffuse into the separated flow and the particles are carried to the tip of the fuel nozzle as they are. Conditions of separation of air at the outer peripheral surface were measured in detail. As a result, it is found that the angle of the cone is desirable to be in a range of 2 to 10°. In a case of the angle being 2° or less, air flowing onto the inner peripheral surface of the cone 15 becomes small, and the speed distribution has a higher speed at the outer peripheral surface of the nozzle. Further, when the angle becomes 10° or larger, air flow is separated at the outer peripheral surface of the cone 15 on the downstream side. Constructions and operations of the other portions are the same as the burner of FIG. 1, so that their explanations are omitted.

The fuel nozzle 2 of the pulverized coal burner of the present embodiment as mentioned above can raise the concentration of fuel at the opening edge portion of the nozzle to about twice the concentration under the transfer conditions. Further, the flow speed distribution can be flattened within +–5% of an average flow speed. Thereby, pulverized coal becomes easy to be ignited, so that denitration reaction in the flame is promoted and the concentration of NOx can be decreased. In a case where bituminous coal of fuel ratio 2.3 is burned and it is compared under the condition of unburned substance 5% in ash at the furnace outlet, the concentration of NOx is reduced by 20% compared with a conventional one. Further, since the fuel concentration at the opening edge portion of the fuel nozzle 2 becomes high, flame can be stably formed even under the condition of lean fuel concentration. Thereby, hitherto, by coal-only burning, stable flame was maintained only until a burner load of 40%, but, in this embodiment the stable flame can be maintained until burner load of 20% and stabilizing fuel such as oil can be decreased.

The pulverized coal burner 1 of the invention is most desirable to be a burner constructed of a fuel nozzle 1, a secondary air nozzle 27 and a third air nozzle 33. However, provision of one auxiliary air nozzle can be sufficient instead of providing separately the secondary air nozzle 27 and the third air nozzle 33.

Further, a stabilizing function of this burner is based on the fact that a negative pressure portion is formed which is lower in atmospheric pressure in the vicinity of the outlet end of the fuel nozzle than its surroundings, circulation flows of pulverized coal and air occur there, and ignitability becomes good. In order to further promote this phenomenon, pulverized coal, the concentration of which is made higher than at the outlet of a pulverizer, is supplied into the negative pressure portion of the nozzle outlet portion.

Further, in the pulverized coal burner 1 of the present invention, in order to change independently the concentration distribution and the flow speed distribution, at the outlet of the fuel nozzle 2, an upstream side portion of the flow path divider or distributor 14 is excellent to be the cone 15 which is the narrowing cylinder, the diameter of which changes to be smaller toward the downstream side. When the flow path divider is provided so that the small diameter portion thereof is positioned on the upstream side, it is difficult to change independently the concentration distribution and the flow speed concentration at the outlet of the fuel nozzle 2. Further, it is apt to receive radiation from the furnace and problems such as thermal deformation and burning damage occur.

Figure 4:
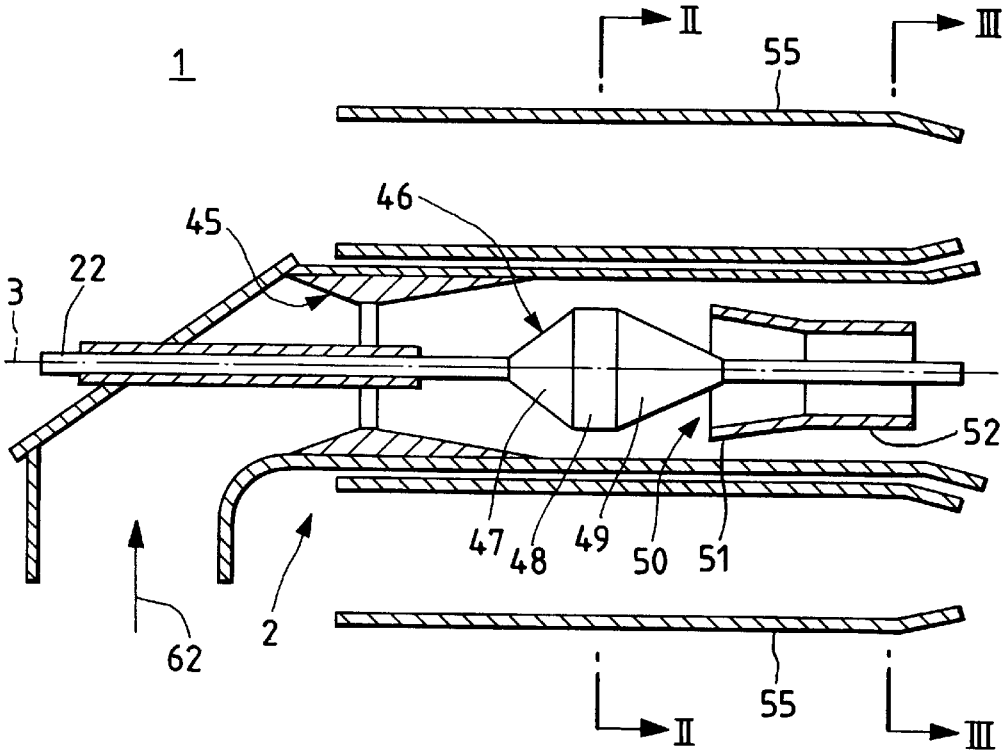
FIG. 4 is a sectional view of a third embodiment similar to FIG. 1.
Figure 5:
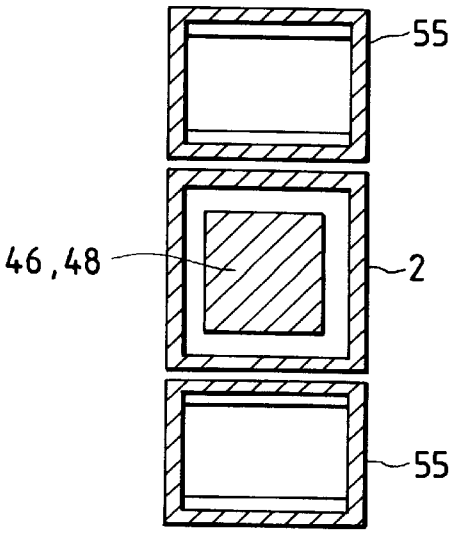
FIG. 5 is a sectional view taken along a line II—II of FIG. 4.
Figure 6:
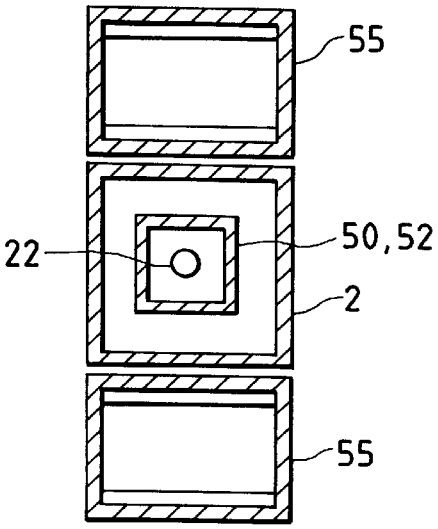
FIG. 6 is a sectional view taken along a line III—III of FIG. 4.

FIG. 4 is a sectional view, of a third embodiment, similar to FIG. 1. FIG. 5 is a sectional view taken along a line II—II of FIG. 4, and FIG. 6 is a sectional view taken along a line III—III of FIG. 4.

The pulverized coal burner 1 of the first or second embodiment has a circular cross-section. The present invention can be applied to a rectangular burner in which the flow path has a rectangular cross-section. The pulverized coal burner 1 of the third embodiment has air nozzles 55 for supplying combustion air on both sides of a fuel nozzle 2 for feeding mixture 62 of pulverized coal and air.

Further, the fuel nozzle 2 is provided with a constricted throat 45 contracting flow of mixture 62 toward the central axis 3 of the fuel nozzle, an impinged diffuser having an expansion portion 47 provided on the central axis 3 of the fuel burner on the downstream side of the constricted throat 45, gradually expanding from the upstream side to the downstream side and causing the mixture 62 to impinge thereon to diffuse, a parallel portion 48 and a narrowing portion 49, and a flow path divider 50, provided coaxially with the central axis 3 of the fuel nozzle on the downstream side of the impinged diffuser 46, and dividing coaxially the flow path, the flow path divider having a narrowing cylinder portion 51 narrowing gradually from the upstream side to the downstream side and a parallel cylinder portion 52 extending from the narrowing cylinder portion 51.

The fuel nozzle 2 and the air nozzles 55 each have a rectangular shape, and the air nozzles 55 are provided on upper and lower sides of the fuel nozzle 2 so as to be adjacent thereto. In a case of this burner, since the flow path is rectangular, the constricted throat 45, the impinged diffuser 46, the flow path divider 50, etc. arranged inside the fuel nozzle 2 also are rectangular in cross-section. When those sectional shapes are coped with the shape of the flow path section, the highest performance is exhibited. However, even in a case where the fuel nozzle itself is rectangular in cross-section, and sectional shapes of the constricted throat 45, the impinged diffuser 46, the flow path divider 50, etc. are circular, virtually the same performance is exhibited.

In the pulverized coal burner 1 of the third embodiment, the fuel burner 2 is provided with the constricted throat 45, the impinged diffuser 46 and the flow path divider 50, whereby the pulverized coal burner provided with the air nozzles on the both sides of the fuel nozzle, has a similar operation to the previously mentioned pulverized coal burner.

Figure 7:
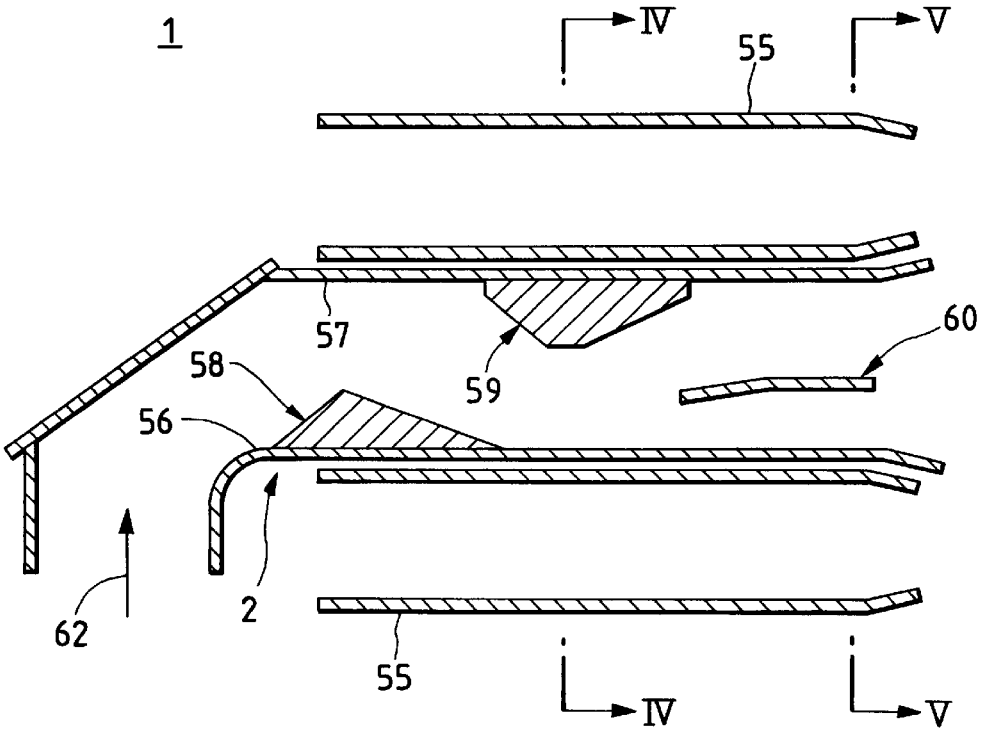
FIG. 7 is a sectional view of a forth embodiment similar to FIG. 1.
Figure 8:
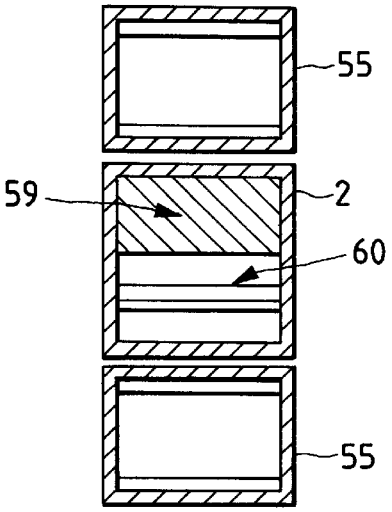
FIG. 8 is a sectional view taken along a line IV—IV of FIG. 7.
Figure 9:
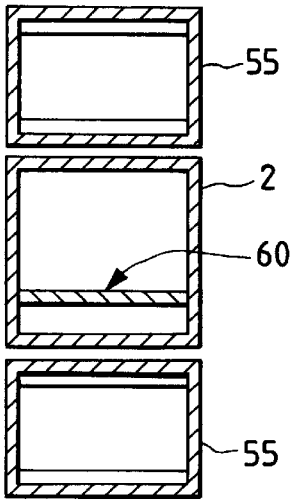
FIG. 9 is a sectional view taken along a line V—V of FIG. 7.

FIG. 7 is a sectional view, of a fourth embodiment, similar to FIG. 1, FIG. 8 is a sectional view taken along a line IV—IV of FIG. 7, and FIG. 9 is a sectional view taken along a line V—V of FIG. 7.

The pulverized coal burner 1 of the forth embodiment has an air nozzles 55 supplying combustion air on both sides of a fuel nozzle 2 jetting mixture 62 of pulverized coal and air. The fuel nozzle 2 is provided with a constricted throat 58 contracting the flow of mixture 62 from one side wall surface to the other side wall surface, an impinged diffuser 59 gradually approaching the mixture from the other wall surface to the one wall surface, and from the upstream side to the downstream side, on the downstream side of the constricted throat 58 and causing the mixture 62 to impinge to diffuse, and a flow path divider 60 dividing the flow path on the downstream side of the impinged diffuser 59.

In a case of the pulverized coal burner of the fourth embodiment, the constricted throat 58 of the fuel nozzle 2, the impinged diffuser 59, and the flow path divider 60 extend uniformly toward the inner part.

The burner, in which the fuel nozzle 2 has the constricted throat 58 contracting the flow of mixture 62 from one side wall surface to the other side wall surface, the impinged diffuser 59 gradually approaching the mixture from the other wall surface 57 to the one wall surface 56 and causing the mixture 62 to impinge to diffuse, and the flow path divider 60 dividing the flow path, has an operation similar to the pulverized coal burner of the previous third embodiment (FIG. 3), and forms stable flame in the vicinity of the pulverized coal burner, promotes thermal decomposition of pulverized coal and reduces the concentration of NOx.

According to the pulverized coal burner of the present invention, the stability of flame at a time of low load operation is raised, the combustion efficiency of pulverized coal is improved, and the reducing flame zone is enlarged to suppress occurrence of NOx.

Further, an amount of use of stabilizing fuel is reduced by enlarging a load range of the burner in which combustion is possible with only pulverized coal.

What is claimed is:

1. A pulverized coal burner having a fuel nozzle for feeding a mixture of pulverized coal and air and an air nozzle for supplying combustion air in a state of swirling flow, said air nozzle being arranged outside said fuel nozzle to be coaxial with said fuel nozzle, wherein said fuel nozzle comprises:

a constricted throat for contracting a flow of said mixture toward a central axis of said fuel nozzle, an impinged diffuser provided on the central axis of said fuel nozzle on the downstream side of said constricted throat, said impinged diffuser having an expanding portion expanding gradually from an upstream side to a downstream side and causing said mixture to impinge on said expanding portion and diffuse, and a flow path divider provided coaxially with said fuel nozzle on the downstream side of said impinged diffuser for dividing a flow path for said mixture in said fuel nozzle into an inner flow path and an outer flow path, said flow path divider having a narrowing cylinder portion gradually narrowing from an upstream side to a downstream side, said narrowing cylinder portion having an upstream side end directly facing said impinged diffuser.

2. A pulverized coal burner having a fuel nozzle for feeding a mixture of pulverized coal and air and an air nozzle for supplying combustion air in a state of swirling flow, said air nozzle being arranged outside said fuel nozzle to be coaxial with said fuel nozzle, wherein said fuel nozzle comprises:

a constricted throat for contracting a flow of said mixture toward a central axis of said fuel nozzle, an impinged diffuser provided on the central axis of said fuel nozzle on the downstream side of said constricted throat, said impinged diffuser having an expanding portion expanding gradually from an upstream side to a downstream side and causing said mixture to impinge on said expanding portion and diffuse, said impinged diffuser further having a parallel portion, being parallel to the central axis of said fuel nozzle and provided on the central axis of said fuel nozzle so as to extend from said expanding portion, and a narrowing portion narrowing from an upstream side to a downstream side, said narrowing portion being provided on the central axis of said fuel nozzle so as to extend from said parallel portion, and a flow path divider provided coaxially with said fuel nozzle on the downstream side of said impinged diffuser for dividing a flow path for said mixture in said fuel nozzle into an inner flow path and an outer flow path, said flow path divider having a narrowing cylinder portion gradually narrowing from an upstream side to a downstream side.

3. A pulverized coal burner according to claim 2, wherein an apex angle of said expanding portion of said impinged diffuser is in a range from 15° to 40°.

4. A pulverized coal burner according to claim 2, wherein an apex angle of said narrowing portion of said impinged diffuser is in the range of 5° to 20°.

5. A pulverized coal burner according to claim 1, wherein said flow path divider further comprises a parallel portion parallel to the central axis of said fuel nozzle, said parallel portion being provided coaxially with the central axis of said fuel nozzle to be parallel to said central axis and extend from said narrowing cylinder portion.

6. A pulverized coal burner according to claim 5, wherein said upstream end of said narrowing portion of said flow path divider is disposed axially close to a downstream side end of said impinged diffuser and a downstream side end of said cylindrical portion of said flow path divider is disposed in the vicinity of a tip of said fuel nozzle.

7. A pulverized coal burner according to claim 1, wherein an angle between an outer surface of said narrowing cylinder portion and the central axis of said fuel burner is in a range of 2° to 10°.

8. A pulverized coal burner according to claim 1, wherein at a tip portion of said fuel nozzle, there are provided a deflection plate for deflecting a flow of combustion air for said air nozzle outwardly and an impingement plate for causing said mixture to impinge thereon.

* * * * *